US012798835B2

(12) United States Patent
Oliveri

(10) Patent No.: US 12,798,835 B2
(45) Date of Patent: Nov. 17, 2026

(54) TAMPER-EVIDENT CLOSURE

(71) Applicant: AIRNOV, INC., Wilmington, DE (US)

(72) Inventor: Cyril Oliveri, Romorantin-Lanthenay (FR)

(73) Assignee: AIRNOV, INC., Wilmington, DE (US)

( * ) Notice: Subject to any disclaimer, the term of this patent is extended or adjusted under 35 U.S.C. 154(b) by 0 days.

(21) Appl. No.: 19/143,489

(22) PCT Filed: Dec. 29, 2023

(86) PCT No.: PCT/EP2023/087987
§ 371 (c)(1),
(2) Date: Jun. 26, 2025

(87) PCT Pub. No.: WO2024/141642
PCT Pub. Date: Jul. 4, 2024

(65) Prior Publication Data

US 2025/0361064 A1 Nov. 27, 2025

(30) Foreign Application Priority Data

Dec. 30, 2022 (EP) ..... 22217352

(51) Int. Cl.
*B65D 41/34* (2006.01)
*B65D 50/04* (2006.01)
(Continued)

(52) U.S. Cl.
CPC ..... *B65D 41/34* (2013.01); *B65D 50/041* (2013.01); *B65D 51/244* (2013.01); *B65D 51/30* (2013.01);
(Continued)

(58) Field of Classification Search
CPC .... B65D 41/34; B65D 50/041; B65D 51/244; B65D 51/30; B65D 53/06; B65D 2215/02;
(Continued)

(56) References Cited

U.S. PATENT DOCUMENTS 3,817,416 A 6/1974 Costa
3,888,375 A * 6/1975 Gerk ..... B65D 50/041 215/219
(Continued)

FOREIGN PATENT DOCUMENTS

CN 202124200 U 1/2012
GB 2137599 A 10/1984
(Continued)

OTHER PUBLICATIONS

International Search Report with Written Opinion of the International Searching Authority, dated Mar. 25, 2024, with respect to International Application No. PCT/EP2023/087987.
(Continued)

*Primary Examiner* — Laura E. Parker
(74) *Attorney, Agent, or Firm* — Scott R. Cox

(57) ABSTRACT

A tamper-evident closure including an outer cap with a sidewall and a top wall; an inner cap with a sidewall and a top wall, coaxially nested in the outer cap; a safety strip arranged between the outer cap and the inner cap to block at least one degree of freedom of relative movement of the outer and inner caps, wherein the safety strip is integrally
(Continued)

made with one cap and connected thereto by a frangible structure; a first engagement mechanism between the safety strip and the other cap, to drive the caps in unison in a screwing direction to mount the closure on the container; a second engagement mechanism between the caps, to drive the caps in unison in an unscrewing direction ($R_2$) to remove the closure from the container, wherein the second engagement mechanism is activatable when the safety strip has been removed.

15 Claims, 8 Drawing Sheets

(51) Int. Cl.
*B65D 51/24* (2006.01)
*B65D 51/30* (2006.01)
*B65D 53/06* (2006.01)

(52) U.S. Cl.
CPC ..... *B65D 53/06* (2013.01); *B65D 2215/02* (2013.01); *B65D 2401/25* (2020.05)

(58) Field of Classification Search
CPC ... B65D 2401/25; B65D 81/266; B65D 53/00
USPC ..... 215/200, 201, 250, 254, 256
See application file for complete search history.

(56) References Cited

U.S. PATENT DOCUMENTS

| | | | | |
|---|---|---|---|---|
| 4,522,307 | A * | 6/1985 | Steiner | B65D 50/041 215/256 |
| 4,534,480 | A | 8/1985 | Santostasi et al. | |
| 5,005,718 | A * | 4/1991 | Buono | B65D 50/041 215/220 |
| 5,736,616 | A | 4/1998 | Ching et al. | |
| 6,332,550 | B1 * | 12/2001 | Bennett | B65D 41/62 220/255 |
| 2012/0067892 | A1 | 3/2012 | Velmer et al. | |
| 2019/0344938 | A1 | 11/2019 | Lebon | |
| 2020/0255206 | A1 * | 8/2020 | Freedman | B65D 43/162 |

FOREIGN PATENT DOCUMENTS

| | | | |
|---|---|---|---|
| WO | 90/01451 | A1 | 2/1990 |
| WO | 97/22534 | A1 | 6/1997 |
| WO | 98/51758 | A1 | 11/1998 |
| WO | 99/48963 | A2 | 9/1999 |
| WO | 2018/149778 | A1 | 8/2018 |
| WO | 2022/129553 | A1 | 6/2022 |

OTHER PUBLICATIONS

Extended European Search Report of the European Patent Office, dated Jul. 2, 2103, with respect to corresponding EP 22 21 7352.8.

* cited by examiner

TAMPER-EVIDENT CLOSURE

FIELD OF THE INVENTION

The present invention relates to a tamper-evident closure for a container having a threaded opening. The invention also relates to a container with a tamper-evident closure and to a specific use thereof.

BACKGROUND OF THE INVENTION

Tamper-evident closures are often used for containers holding pharmaceutical substances. One safety feature of such closures, which may be combined with child-resistant features, is to allow detection of whether the closure has already been opened before. For screw caps, a solution for providing a tamper-evident function involves welding a foil on the upper surface of the opening of the container. However, with such a solution, it is no longer possible to integrate a chamber in the closure to receive an active material intended to control the atmosphere within the container.

Another common tamper-evident indicator is a collar arranged at the lower end of the cap or closure, the collar being so lightly secured to the cap that a relatively slight parting force between the cap and the collar results in these parts being separated from each other. In particular, WO9722534A1 discloses a collar provided internally with bosses that are arranged to cooperate with corresponding bosses on the outer side of the container. The engagement of the cooperating bosses restricts the relative angle of rotation between the collar and the container. Opening the cap requires removal of the collar, thus providing an indication that the cap has been opened. However, such a solution can only be implemented with containers having adapted bosses corresponding to those of the collar.

It is these drawbacks that the invention is intended more particularly to remedy by proposing a closure which can be used for any type of screw-necked containers and makes it possible to provide active control of the atmosphere in the container, the mounting of the closure on a container also being compatible with conventional container filling lines used in the pharmaceutical sector.

DISCLOSURE OF THE INVENTION

For this purpose, a subject of the invention is a tamper-evident closure for a container having an opening with a thread, the closure comprising:

an outer cap with a first sidewall and a first top wall;

an inner cap with a second sidewall and a second top wall, the inner cap comprising a cap thread configured to cooperate with the container thread, the inner cap being coaxially nested in the outer cap;

a safety strip arranged between the outer cap and the inner cap so as to block at least one degree of freedom of relative movement of the outer and inner caps, the safety strip being integrally made with one cap among the outer and inner caps and connected thereto by a frangible structure;

a first engagement mechanism between the safety strip and the other cap among the outer and inner caps, configured to drive the outer and inner caps in unison in a direction of screwing the cap thread onto the container thread in order to mount the closure on the container, wherein the first engagement mechanism is activatable without breaking the frangible structure, by application on the outer cap of a rotational torque in the direction of screwing;

a second engagement mechanism between the outer cap and the inner cap, configured to drive the outer and inner caps in unison in a direction of unscrewing the cap thread relative to the container thread in order to remove the closure from the container, wherein the second engagement mechanism is activatable when the safety strip has been removed, by application on the outer cap of a rotational torque in the direction of unscrewing and at least one additional force for activating at least one degree of freedom of relative movement of the outer and inner caps originally blocked by the safety strip.

Thanks to its specific structure including a safety strip attached between two parts of the closure without being bound to the container, the tamper-evident closure of the invention can be used for all screw-necked containers. Without any modification to a conventional bottle or container, it makes it possible to combine the three functions of being child-resistant, tamper-evident and providing active control of the atmosphere in the container. The mounting of the tamper-evident closure on a container can be integrated in conventional production lines, the safety strip remaining attached to the closure upon mounting, whereas the child-resistant function for the opening of the closure can be activated only after removal of the safety strip.

According to one feature, the safety strip is configured to keep, at least locally, facing walls of the outer and inner caps at a first distance from each other, and the second engagement mechanism is activatable, when the safety strip has been removed, by application on the outer cap of a rotational torque in the direction of unscrewing and at least one additional force to bring the facing walls of the outer and inner caps, at least locally, to a second distance from each other less than the first distance.

According to one embodiment, the inner cap is coaxially nested in the outer cap and shaped to allow a relative axial movement such that the first and second top walls of the outer and inner caps can be moved towards or away from each other in the direction of a main axis of the closure; the safety strip is configured to keep, at least locally, the first and second top walls at a first axial distance from each other; and the second engagement mechanism is activatable, when the safety strip has been removed, by application on the outer cap of a rotational torque in the direction of unscrewing and an additional force which is an axial force in the direction of the main axis to bring the first and second top walls of the outer and inner caps, at least locally, to a second axial distance from each other less than the first axial distance. In this embodiment, the second engagement mechanism is a "push-and-turn" child-resistant mechanism.

According to one embodiment, the inner cap is coaxially nested in the outer cap and shaped to allow a relative radial movement such that the first and second sidewalls of the outer and inner caps can be moved towards or away from each other in a direction transverse to a main axis of the closure; the safety strip is configured to keep, at least locally, the first and second sidewalls at a first radial distance from each other; and the second engagement mechanism is activatable, when the safety strip has been removed, by application on the outer cap of a rotational torque in the direction of unscrewing and an additional force which is a radial force in a direction transverse to the main axis to bring the first and second sidewalls of the outer and inner caps, at least locally, to a second radial distance from each other less than the first radial distance. In this embodiment, the second engagement mechanism is a "squeeze-and-turn" child-resistant mechanism.

According to one embodiment, the inner cap is coaxially nested in the outer cap and shaped to allow both a relative axial movement of the first and second top walls of the outer and inner caps and a relative radial movement of the first and second sidewalls of the outer and inner caps; the safety strip is configured to keep, at least locally, the first and second top walls at a first axial distance from each other and the first and second sidewalls at a first radial distance from each other; and the second engagement mechanism is activatable, when the safety strip has been removed, by application on the outer cap of a rotational torque in the direction of unscrewing and two additional forces, comprising an axial force in the direction of the main axis to bring the first and second top walls of the outer and inner caps, at least locally, to a second axial distance from each other less than the first axial distance, and a radial force in a direction transverse to the main axis to bring the first and second sidewalls of the outer and inner caps, at least locally, to a second radial distance from each other less than the first radial distance. In this embodiment, the second engagement mechanism is a "push-and-squeeze-and-turn" child-resistant mechanism.

According to one feature, the safety strip is made of the same material as the cap to which it is connected by the frangible structure.

According to one feature, the safety strip is an injection molded part made in one piece with the frangible structure and the cap to which it is connected by the frangible structure.

According to one feature, the safety strip comprises a grip tab. This improves the ergonomics for opening the closure.

In one embodiment, the frangible structure comprises a continuous thinned portion between the safety strip and the cap to which it is connected by the frangible structure.

In another embodiment, the frangible structure comprises a plurality of frangible bridges between the safety strip and the cap to which it is connected by the frangible structure.

According to one feature of the invention, the second engagement mechanism comprises coupling elements which, when the safety strip has been removed, are brought in mutual engagement under the effect of the at least one additional force against an elastic action of at least one elastic element of the closure, in such a way that the coupling elements of the second engagement mechanism are automatically disengaged when the at least one additional force is released.

According to one embodiment, the outer cap is elastically deformable, the coupling elements of the second engagement mechanism being brought in mutual engagement through a reversible elastic deformation of the outer cap. In one embodiment, the engagement of the coupling elements of the second engagement mechanism may result from an elastic deformation of the outer cap under the effect of an axial force applied in the direction of the main axis of the closure and, when the axial force is released, the outer cap may elastically return to its initial configuration, thus automatically disengaging the coupling elements of the second engagement mechanism. In one embodiment, the engagement of the coupling elements of the second engagement mechanism may result from an elastic deformation of the outer cap under the effect of a radial force applied in a direction transverse to the main axis of the closure and, when the radial force is released, the outer cap may elastically return to its initial configuration, thus automatically disengaging the coupling elements of the second engagement mechanism.

According to another embodiment, the closure comprises at least one elastic member provided between the outer cap and the inner cap, for biasing, at least locally, facing walls of the outer and inner caps away from each other, the coupling elements of the second engagement mechanism being brought in mutual engagement against the elastic action of the at least one elastic member. In one embodiment, the at least one elastic member is configured to bias, at least locally, the first and second top walls of the outer and inner caps away from each other in an axial direction parallel to the main axis of the closure, the coupling elements of the second engagement mechanism being brought in mutual engagement against the elastic action of the at least one elastic member. In one embodiment, the at least one elastic member is configured to bias, at least locally, the first and second sidewalls of the outer and inner caps away from each other in a radial direction transverse to the main axis of the closure, the coupling elements of the second engagement mechanism being brought in mutual engagement against the elastic action of the at least one elastic member.

According to one embodiment, the inner cap comprises a sealing member configured to provide a moisture-tight seal between the inner cap and the container opening.

According to one embodiment, the sealing member comprises a flat sealing surface forming an inner surface of the inner cap positioned transversally to the main axis so as to provide a moisture-tight seal between the inner cap and an upper surface of the container opening. Such a flat sealing surface positioned transversally to the main axis makes it possible to adapt to a wide range of containers.

In one embodiment, the sealing member is made of a thermoplastic elastomer (TPE) having a Shore A hardness of between 30 and 70. In the context of the invention, the Shore A hardness of a thermoplastic elastomer (TPE) may be measured according to standard ASTM D2240. Thanks to the Shore A hardness of its constituent thermoplastic elastomer, the sealing member is flexible enough to absorb surface irregularities of the upper surface of the container opening which may result, e.g., from its manufacturing process, such as molding defects or cutting marks.

According to one feature, the inner cap is an injection molded part. In one embodiment, the inner cap comprises a main body made of a thermoplastic polymer, such as a polyolefin-based polymer, and a sealing member made of a thermoplastic elastomer (TPE). In one embodiment, the inner cap is obtained by injection molding of the sealing member over the main body.

According to one embodiment, the first engagement mechanism comprises coupling elements on the safety strip which are complementary to coupling elements of the other cap among the outer and inner caps and engaged therewith, wherein, when a rotational torque in the direction of screwing is applied on the outer cap, the coupling elements on the safety strip are in a locking arrangement with the coupling elements of the other cap so that the inner cap is rotated in unison with the outer cap in the direction of screwing.

According to one embodiment, the inner cap defines a cavity for receiving an active material. Within the meaning of the invention, an active material is a material capable of regulating the atmosphere in the container. The active material may be any type of active material. In particular, the active material may belong to a group of: humidity absorbers (or desiccants); oxygen scavengers; odor absorbers; and/or emitters of humidity or volatile olfactory organic compounds. Optionally, the active material may be capable of releasing gaseous substances such as moisture or perfume. Such properties can for example be useful for applications where sensitive products require a certain humidity level. Such products are, for example, powders, especially for generating aerosols, gelatin capsules, herbal medicine, gels and creams including cosmetics, and food products.

Examples of suitable humidity absorbers include, without limitation, silica gels, dehydrating clays, activated alumina, calcium oxide, barium oxide, natural or synthetic zeolites, molecular or similar sieves, or deliquescent salts such as magnesium sulfide, calcium chloride, aluminum chloride, lithium chloride, calcium bromide, zinc chloride or the like. Preferably, the humidity absorber is a molecular sieve and/or a silica gel.

Examples of suitable oxygen scavengers include, without limitation, metal powders having a reducing capacity, in particular iron, zinc, tin powders, metal oxides still having the ability to oxidize, in particular ferrous oxide, as well as compounds of iron such as carbides, carbonyls, hydroxides, used alone or in the presence of an activator such as hydroxides, carbonates, sulfites, thiosulfates, phosphates, organic acid salts, or hydrogen salts of alkaline metals or alkaline earth metals, activated carbon, activated alumina or activated clays. Other agents for collecting oxygen can also be chosen from specific reactive polymers such as those described for example in the patent documents U.S. Pat. No. 5,736,616A, WO99/48963A2, WO98/51758A1 and WO2018/149778A1.

Another subject of the invention is a container with a closure as described above, the closure being fixedly screwed onto a thread of the container and closing same.

Another subject of the invention is a use of a container as described above for containing moisture-sensitive items, such as tablets or capsules containing a pharmaceutical composition; nutraceuticals; herbalism products; diagnostic products.

BRIEF DESCRIPTION OF THE DRAWINGS

Features and advantages of the invention will become apparent from the following description of several embodiments of a tamper-evident closure and a container according to the invention, this description being given merely by way of example and with reference to the appended drawings in which.

ILLUSTRATIVE EMBODIMENTS OF THE INVENTION

Figure 7:
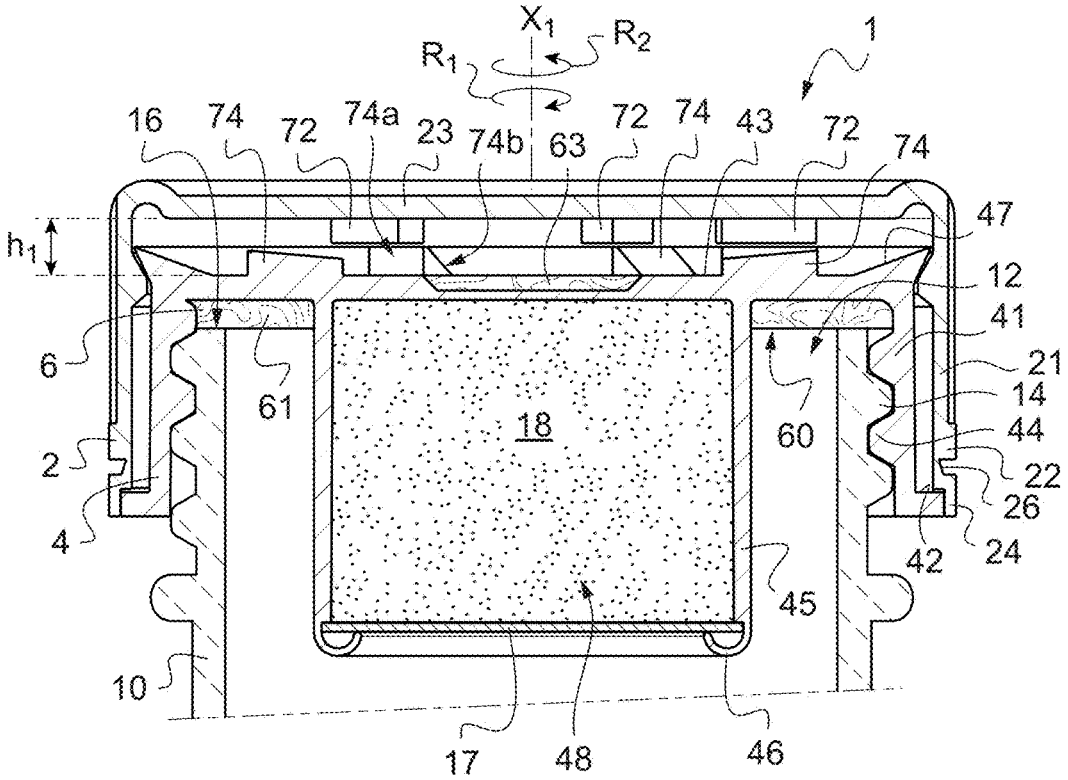
FIG. 7 is a cross section at larger scale according to plane VII of FIG. 1.

In the first embodiment shown in FIGS. 1 to 9, the tamper-evident closure 1 according to the invention is configured to be screwed onto a container 10 which, as visible in FIG. 7, has an opening 12 provided with an external thread 14. The shape of the container 10 shown in the figures only serves as an example, it being understood that the container 10 can have any shape, as long as it is provided with an opening surrounded, either externally as shown in the figures, or else internally, by a thread 14 on which the closure 1 can be screwed. In the example of FIG. 7, the container is provided with a neck portion. However, it is also possible to provide the container in the shape of a bottle with a relatively narrow neck, or in the shape of a straight cylinder. Likewise, it is possible to provide non-rotational geometries for the container, as long as it is provided with an annular container thread, which may be a continuous thread or an interrupted thread.

Figure 1:
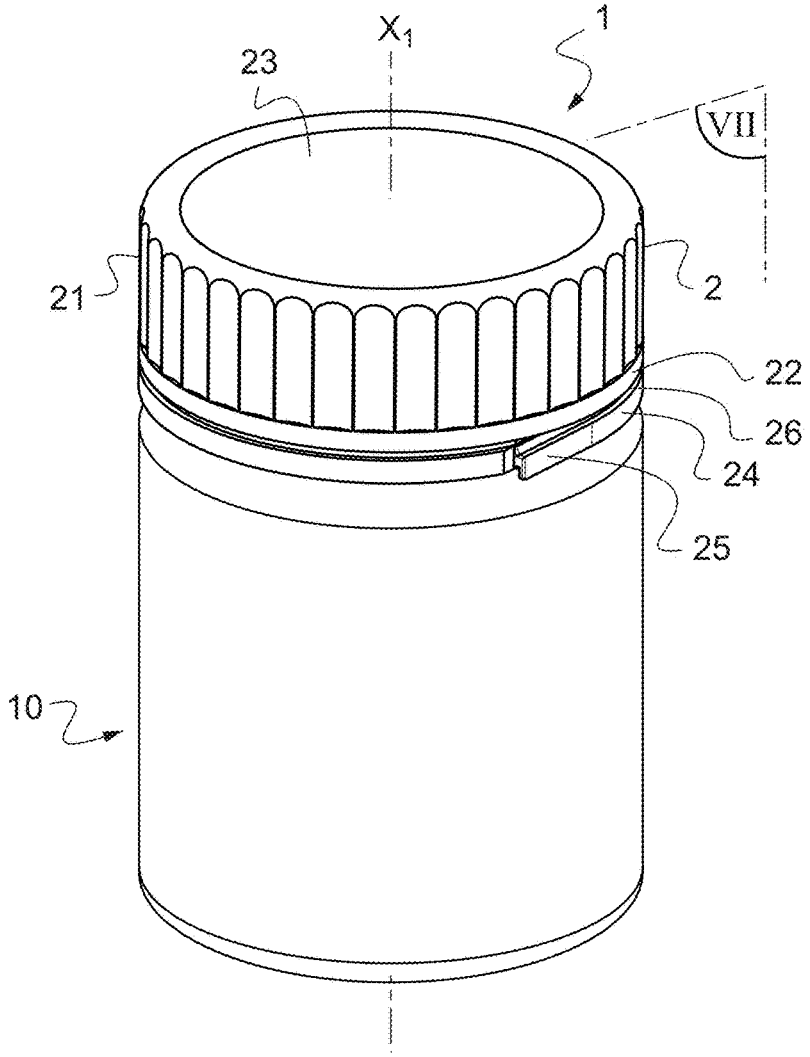
FIG. 1 is a perspective view of a container with a tamper-evident closure according to a first embodiment of the invention.

The closure 1 comprises two caps which are nested inside each other. In FIG. 1, only the outer cap 2 is visible, which comprises a first sidewall 21 and a first top wall 23. The first sidewall 21 can be provided with suitable means to increase the grip for a user. In the example shown, a plurality of ribs are provided on the first sidewall 21, extending axially in the direction of a main axis $X_1$ of the closure. A distal end 22 of the outer cap 2 is connected to a safety strip 24 by a frangible structure 26. In this embodiment, the frangible structure 26 is a continuous thinned portion of material between the safety strip 24 and the distal end 22. In a variant, the frangible structure 26 may be formed by a plurality of frangible bridges regularly distributed at the periphery between the safety strip 24 and the distal end 22. The safety strip can be detached from the first sidewall 21 by being grasped at a grip tab 25.

Figure 3:
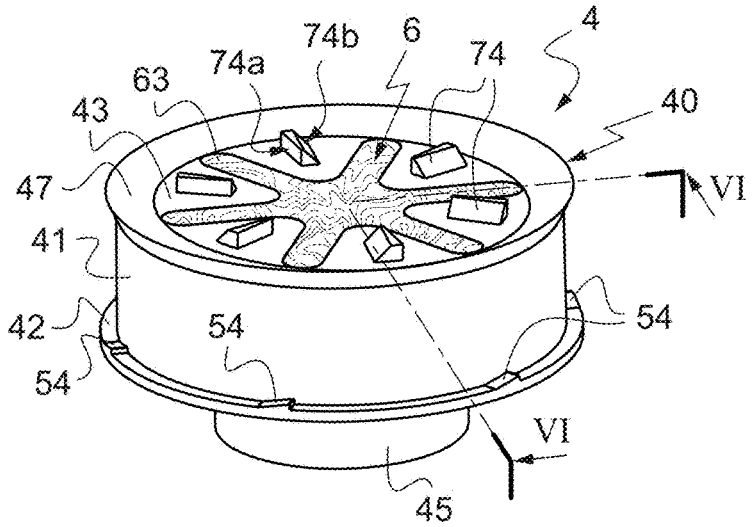
FIG. 3 is a perspective top view of the inner cap of the tamper-evident closure of FIG. 1.
Figure 4:
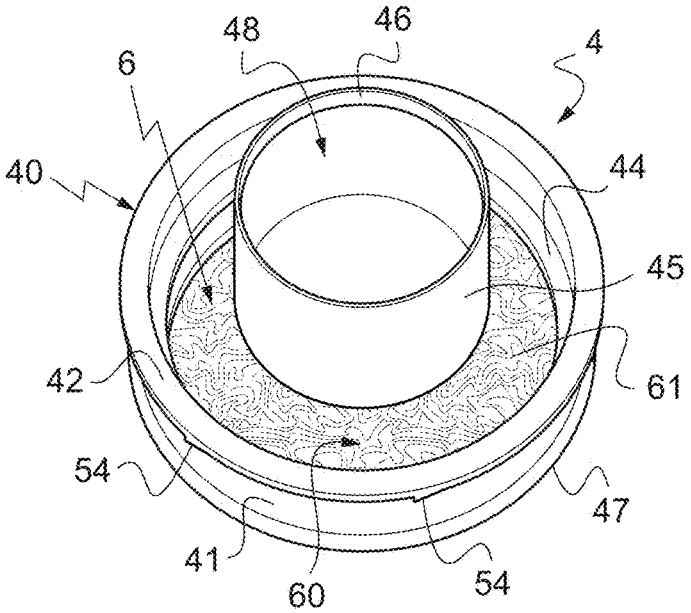
FIG. 4 is a perspective bottom view of the inner cap of the tamper-evident closure of FIG. 1.
Figure 5:
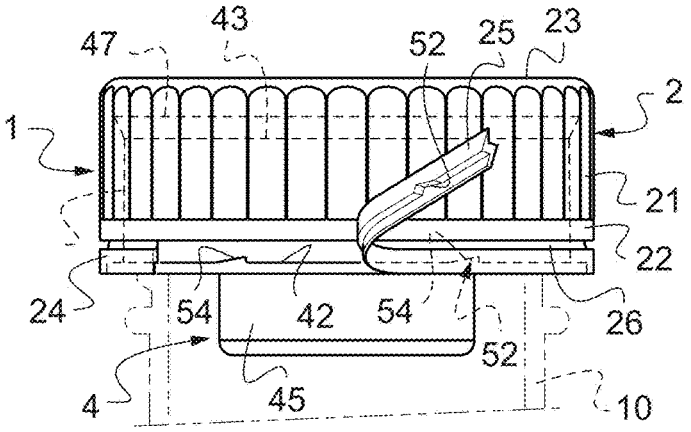
FIG. 5 is a side view of the tamper-evident closure of FIG. 1 with partial removal of the safety strip.
Figure 6:
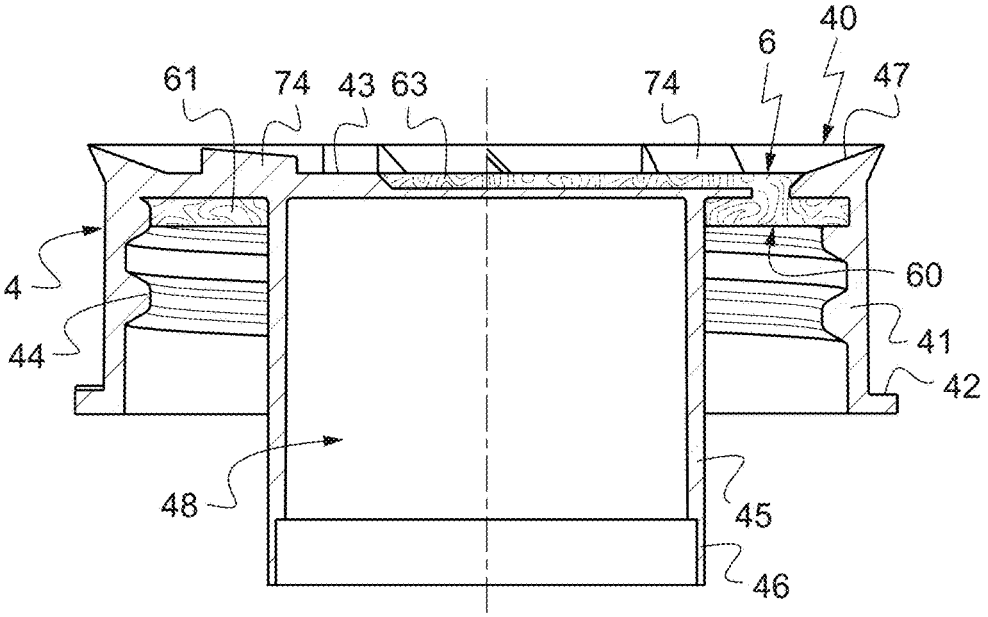
FIG. 6 is a cross section at larger scale according to planes VI-VI of FIG. 3.

As shown in FIGS. 3 and 4, the inner cap 4 comprises a main body 40 with a second sidewall 41 and a second top wall 43. In this first embodiment, the safety strip 24 is configured to block a relative axial movement of the outer and inner caps 2, 4 and keep the first and second top walls 23, 43 at a first axial distance $h_1$ from each other, as visible in FIG. 7. The second top wall 43 is provided with a projecting peripheral edge 47, configured to guide a relative axial movement of the outer and inner caps 2, 4, so that the first and second top walls 23, 43 can be moved towards or away from each other in the direction of a main axis $X_1$ of the closure when the safety strip 24 has been removed.

The main body 40 of the inner cap 4 is provided with an inner cap thread 44 which is configured to cooperate with the container thread 14 of the container 10. In this way, the closure 1 can be screwed onto the neck of the container 10 by rotation in a screwing direction $R_1$ which, in this example, is a clockwise direction. Similarly to the container thread, the cap thread 44 may be a continuous thread or an interrupted thread. The inner cap 4 also comprises a sealing insert 6 configured to establish a sealing contact with the upper surface 16 of the container opening 12.

The sealing insert 6 comprises a flat sealing surface 60 forming an inner surface of the inner cap 4 positioned transversally to the main axis $X_1$. In this embodiment, the flat sealing surface 60 is made of a thermoplastic elastomer (TPE) having a Shore A hardness of between 30 and 70. As best visible in FIGS. 3, 4 and 6, the sealing insert 6 comprises a star-shaped top portion 63, from which protrudes an annular portion 61 defining the flat sealing surface 60. Of course, the sealing insert 6 may have shapes other than that shown in the figures, in particular the compressible sealing surface 60 may not be flat. For example, in a variant, the annular portion 61 of the sealing insert 6 may take the form of an annular semi-torus. Whatever the shape of the sealing insert 6, the compressible sealing surface 60 makes it possible to adjust to different dimensional variations of the neck of a bottle or a container on which the closure 1 is used, and to absorb surface irregularities of the upper surface 16 of the container opening.

Advantageously, the inner cap 4 is an injection molded part. The main body 40 may be made of a thermoplastic polymer, whereas the sealing insert 6 is made of a thermoplastic elastomer (TPE). In this case, the inner cap 4 is advantageously obtained by injection molding the sealing insert 6 made of TPE over the main body 40 made of a thermoplastic polymer.

The inner cap 4 further comprises an annular wall 45, which defines a cavity 48 for receiving an active material 18 capable of regulating the atmosphere in the container 10, in particular a desiccant and/or an oxygen scavenger. As shown in FIG. 7, the cavity 48 is closed by a gas-permeable cover 17, which retains the active material 18 inside the cavity. In the represented example, the gas-permeable cover 17 is a cardboard held at its periphery by thinner extensions 46 of the annular wall 45 which have been crimped. In a variant, the gas-permeable cover 17 may be a porous membrane secured to the distal end of the annular wall 45, e.g. by heat-sealing, ultrasonic welding, overmolding, etc. In another variant, the inner cap 4 may be provided with a suitable attachment structure for holding a prefabricated canister containing an active material.

The second sidewall 41 of the inner cap 4 comprises at its distal end a radially outwardly extending flange 42. In the direction of the main axis $X_1$, the safety strip 24 abuts against the outer flange 42 in a such a way as to firmly hold the outer cap 2 on the inner cap 4, so that it can no longer be removed from the inner cap 4. A relative rotation between the outer cap 2 and the inner cap 4 is also prevented by the presence of hook-shaped notches 52 in the safety strip 24, configured to cooperate with complementary hook-shaped teeth 54 provided on the outer flange 42 of the inner cap. The hook-shaped notches 52 and the hook-shaped teeth 54 are the coupling elements of a first engagement mechanism. In the non-limiting example represented in the figures, the first engagement mechanism comprises six hook-shaped notches 52 on the safety strip 24 of the outer cap 2 configured to cooperate with six hook-shaped teeth 54 of the inner cap 4.

In operation, the outer cap 2 and the inner cap 4 nested therein can be rotated together to mount the closure 1 on the container 10. The clockwise rotation direction $R_1$ for screwing the cap thread 44 onto the container thread 14 brings each hook-shaped notch 52 in engagement with a corresponding hook-shaped tooth 54. Each hook-shaped tooth 54 provides an abutment for the corresponding hook-shaped notch 52, so that the inner cap is rotated in unison with the outer cap in the direction of screwing $R_1$. This locking interaction between the hook-shaped notches 52 and the hook-shaped teeth 54 is dimensioned to allow the first mounting of the closure 1 on the container without breaking the frangible structure 26.

Figure 2:
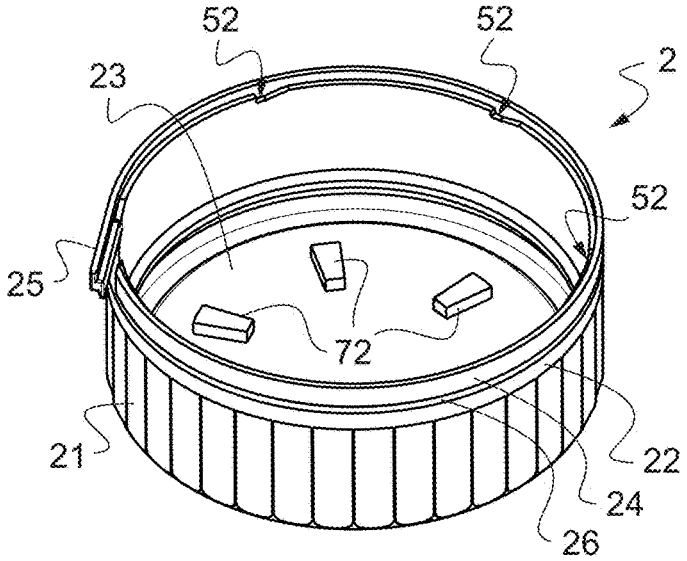
FIG. 2 is a perspective bottom view of the outer cap of the tamper-evident closure of FIG. 1.
Figure 9:
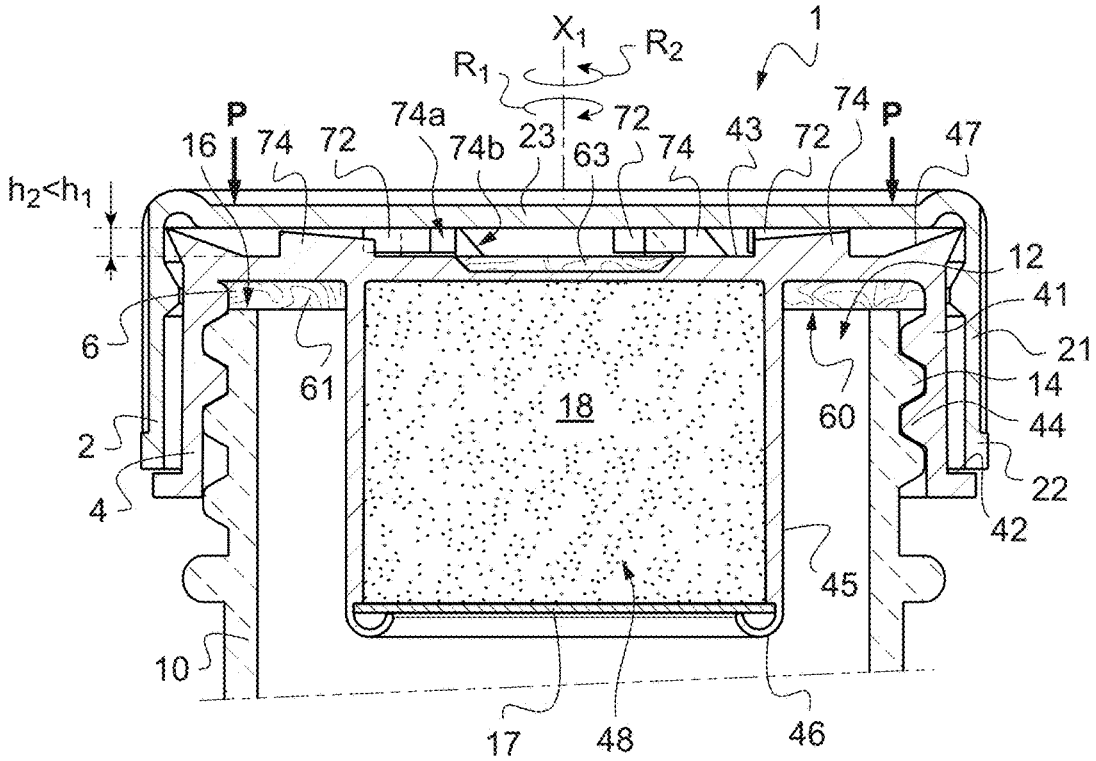
FIG. 9 is a cross section similar to FIG. 7, in a configuration of the tamper-evident closure corresponding to a second step of unscrewing the closure from a container.

As can be seen in FIG. 2, the outer cap 2 also comprises a plurality of concentric driving ribs 72, regularly distributed on the inner side of the first top wall 23 which faces the second top wall 43 of the inner cap 4. On the outer side of the second top wall 43, the inner cap 4 comprises a plurality of wedge-shaped elements 74 with beveled inclined surface. Each wedge-shaped element 74 is configured to cooperate with a driving rib 72 of the outer cap, thus forming a second engagement mechanism. When the outer cap 2 is axially displaced toward the inner cap 4, after the safety strip 24 has been removed, to bring the first and second top walls 23, 43 to a second distance $h_2$ from each other which is less than the first distance $h_1$ as shown in FIG. 9, each driving rib 72 is received in the interspace between two successive wedge-shaped elements 74, more precisely between a straight edge 74*a* of a first wedge-shaped element 74 in the direction of screwing $R_1$ and a slanted edge 74*b* of a second wedge-shaped element 74 in the direction of unscrewing $R_2$. In the non-limiting example represented in the figures, the second engagement mechanism comprises six driving ribs 72 on the outer cap 2 configured to cooperate with six wedge-shaped elements 74 of the inner cap 4.

Figure 8:
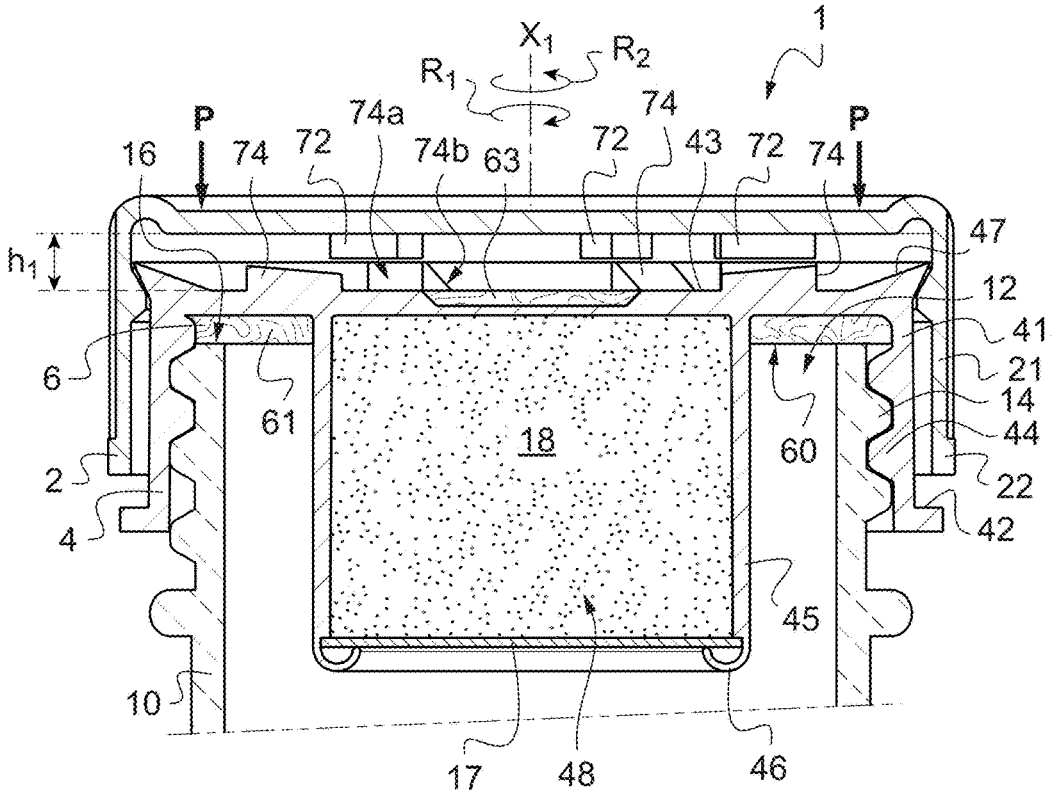
FIG. 8 is a cross section similar to FIG. 7, in a configuration of the tamper-evident closure corresponding to a first step of unscrewing the closure from a container.

In operation, when a user rotates the outer cap 2 in the direction of unscrewing $R_2$, in an attempt to open the closure 1 without applying an axial force on the outer cap 2 in the direction of the main axis $X_1$, the driving ribs 72 slip over the slanted edges 74*b* of the wedge-shaped elements 74 and the rotation of the outer cap 2 does not lead to a corresponding rotation of the inner cap 4. An opening of the closure 1 requires that the driving ribs 72 of the outer cap 2 are brought in engagement with a deeper portion of the edges 74*b* of the wedge-shaped elements 74, which is only possible when the outer cap 2 is axially displaced and deformed toward the inner cap 4, in particular under the action of an axial pushing force P applied on the top wall 23 in the direction of the main axis $X_1$, as shown in FIGS. 8 and 9. In practice, when the axial pushing force P on the outer cap 2 is released, the outer cap elastically returns to its initial configuration, which disengages the driving ribs 72 from the edges 74*b* of the wedge-shaped elements 74.

As can be seen from the above description, the mounting (or closing) of the closure 1 of the first embodiment onto a container is easy to achieve and only requires a simple rotational movement of the outer cap 2 in the direction of screwing $R_1$, whereas the opening of the closure 1 requires a complex operation starting with an axial displacement of the outer cap 2 toward the inner cap 4 under an axial pushing force P in the direction of the main axis $X_1$, followed by a rotational movement in the direction of unscrewing $R_2$ while maintaining the axial pushing force P. Such complex "push-and-turn" operation establishes a highly effective child resistance of the closure 1.

Figure 10:
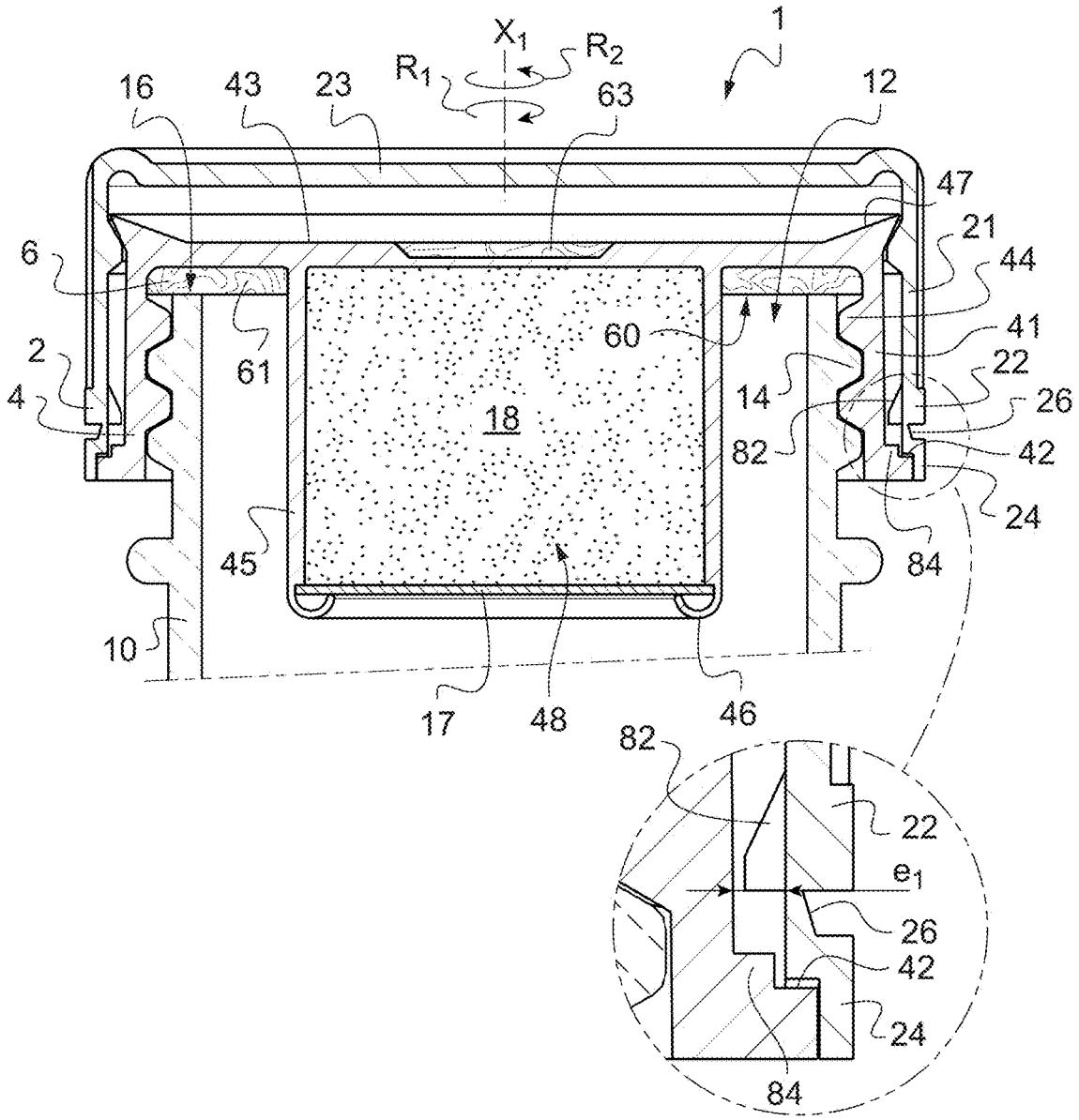
FIG. 10 is a partial cross section similar to FIG. 7 for a tamper-evident closure according to a second embodiment of the invention.
Figure 11:
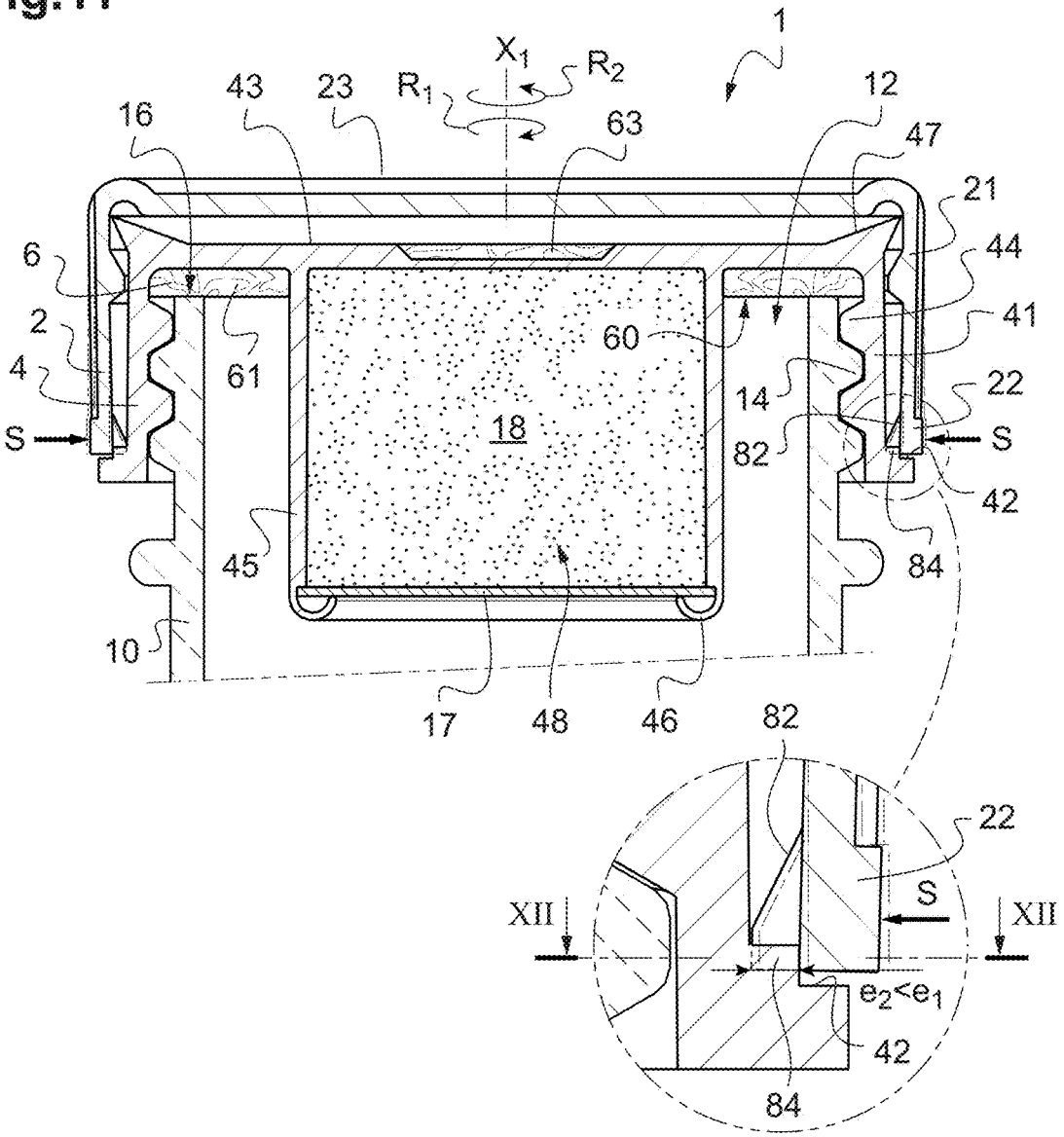
FIG. 11 is a partial cross section similar to FIG. 10, in a configuration of the tamper-evident closure corresponding to a step of unscrewing the closure from a container.
Figure 12:
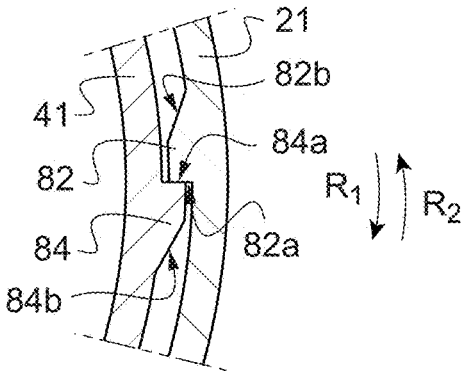
FIG. 12 is a cross section at larger scale according to line XII-XII of FIG. 11.

In the second embodiment shown in FIGS. 10 to 12, elements that are similar to those of the first embodiment have the same references. The tamper-evident closure 1 of the second embodiment differs from the first embodiment in that the second engagement mechanism of the closure is a "squeeze-and-turn" child-resistant mechanism, instead of a "push-and-turn" child-resistant mechanism. In the second embodiment, the removal of the safety strip 24 releases both a degree of freedom of axial translation parallel to the main axis $X_1$ of the closure 1, and a degree of freedom of radial compression transversely to the main axis $X_1$ of the closure 1.

More precisely, as can be seen in FIGS. 10 and 11, the outer cap 2 comprises, in the vicinity of the distal end 22, a plurality of radial teeth 82 regularly distributed on the inner side of the first sidewall 21 which faces the second sidewall 41 of the inner cap 4. Each radial tooth 82 of the outer cap 2 is configured to cooperate with a corresponding radial tooth 84 provided on the outer side of the second sidewall 41 the inner cap, projecting from the outer flange 42. The radial teeth 82 and 84 form a second engagement mechanism, which is activatable only when the safety strip 24 has been removed. In the configuration of FIGS. 11 and 12 where the safety strip 24 has been removed, the outer cap 2 has automatically moved axially towards the inner cap 4, under the effect of gravity in the direction of the main axis $X_1$. As can be seen in FIG. 12, the radial teeth 82 and 84 each have a respective straight edge 82*a*, 84*a* and a respective slanted edge 82*b*, 84*b*. As shown in FIGS. 11 and 12, the straight edges 82*a*, 84*a* are arranged so as to be brought together in the direction of screwing $R_1$, whereas the slanted edges 82*b*, 84*b* are arranged so as to be brought together in the direction of unscrewing $R_2$.

In operation, when a user rotates the outer cap 2 in the direction of unscrewing $R_2$, in an attempt to open the closure 1 without applying a radial squeezing force on the distal end 22 of the outer cap 2 transversely to the main axis $X_1$, the slanted edges 82*b* of the radial teeth 82 slip over the slanted edges 84*b* of the radial teeth 84. The first sidewall 21 of the outer cap slightly increases in diameter locally when a radial tooth 82 passes above a radial tooth 84, and the rotation of the outer cap 2 does not lead to a corresponding rotation of the inner cap 4. An opening of the closure 1 requires that the slanted edges 82*b* of the radial teeth 82 of the outer cap are brought in engagement with a deeper portion of the slanted edges 84*b* of the radial teeth 84 of the inner cap and that an enlargement of the diameter of the first sidewall 21 of the outer cap 2 is blocked, which is only possible when the first sidewall 21 of the outer cap is radially displaced and deformed toward the second sidewall 41 of the inner cap 4, in particular under the action of a radial squeezing force S applied on the distal end 22 of the outer cap 2, as shown in FIG. 11. In practice, when the radial squeezing force S on the outer cap 2 is released, the outer cap elastically returns to its initial configuration, which disengages the slanted edges 82*b* of the radial teeth 82 from the slanted edges 84*b* of the radial teeth 84.

In the second embodiment, the opening of the closure 1 requires a complex operation starting with a radial displacement of the distal end 22 of the outer cap 2, at least locally, toward the inner cap 4 under a radial squeezing force S transverse to the main axis $X_1$, followed by a rotational movement in the direction of unscrewing $R_2$ while maintaining the radial squeezing force S. Similarly to the "push-and-turn" operation of the first embodiment, such a "squeeze-and-turn" operation also establishes a highly effective child resistance of the closure 1.

It is understood that, in a variant of the "squeeze-and-turn" second engagement mechanism of the second embodiment, the radial teeth 82 of the outer cap 2 and the radial teeth 84 of the inner cap 4 may be provided at a same height along the main axis $X_1$ of the closure when the safety strip 24 is attached between the outer cap and the inner cap, instead of being axially offset as shown in FIG. 10. In this variant, which is part of the invention even if not shown in the figures, the second engagement mechanism is directly activatable without the need for prior relative axial movement of the outer and inner caps. In this case, the engagement of the radial teeth 82 of the outer cap with the radial teeth 84 of the inner cap is obtained directly by applying a radial squeezing force on the first sidewall 21 of the outer cap 2, transversely to the main axis $X_1$.

In some embodiments of the above variant, the radial squeezing force may be applied in the vicinity of the distal end 22 and used, on the one hand, to break the frangible structure 26 at the junction with the safety strip 24 and, on the other hand, to engage the coupling elements 82, 84 of the second engagement mechanism. However, in other embodiments, it may be preferable to design the frangible structure 26 so that it cannot be easily broken under the effect of a radial squeezing force, in which case the safety strip 24 must first be removed, e.g., using the grip tab 25, to release the degree of freedom of relative radial movement of the first and second sidewalls, before the radial squeezing force can be applied, at least locally, on the first sidewall 21 of the outer cap 2 to engage the coupling elements 82, 84 of the second engagement mechanism.

Figure 13:
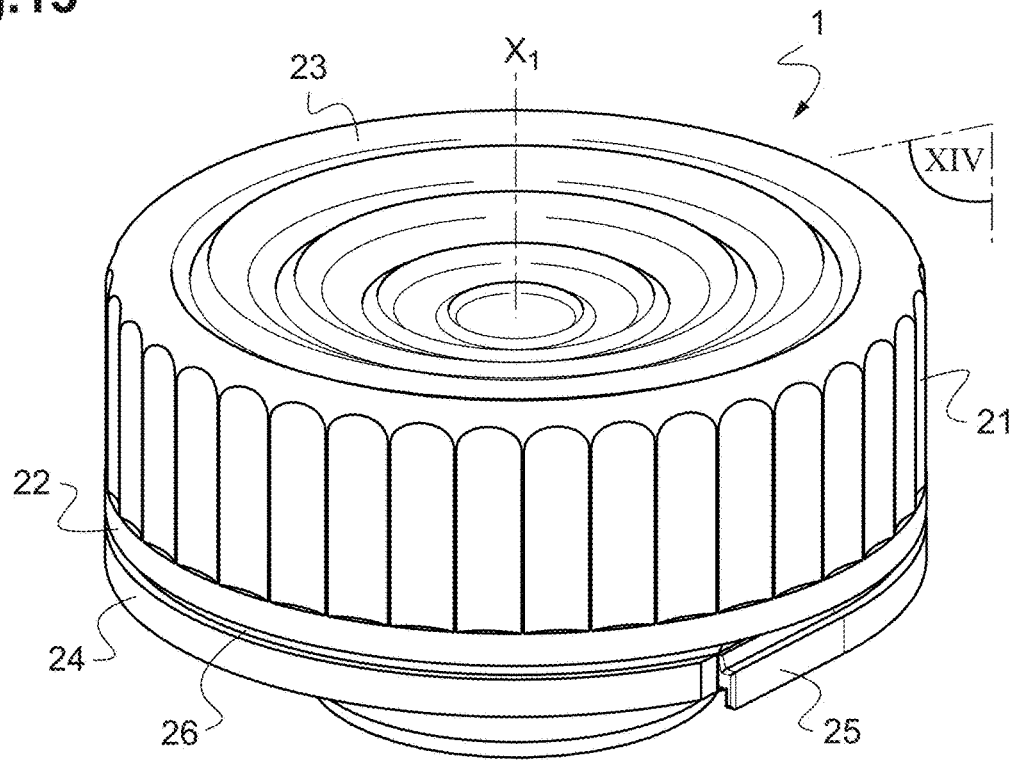
FIG. 13 is a perspective view similar to FIG. 1 for a tamper-evident closure according to a third embodiment of the invention.
Figure 14:
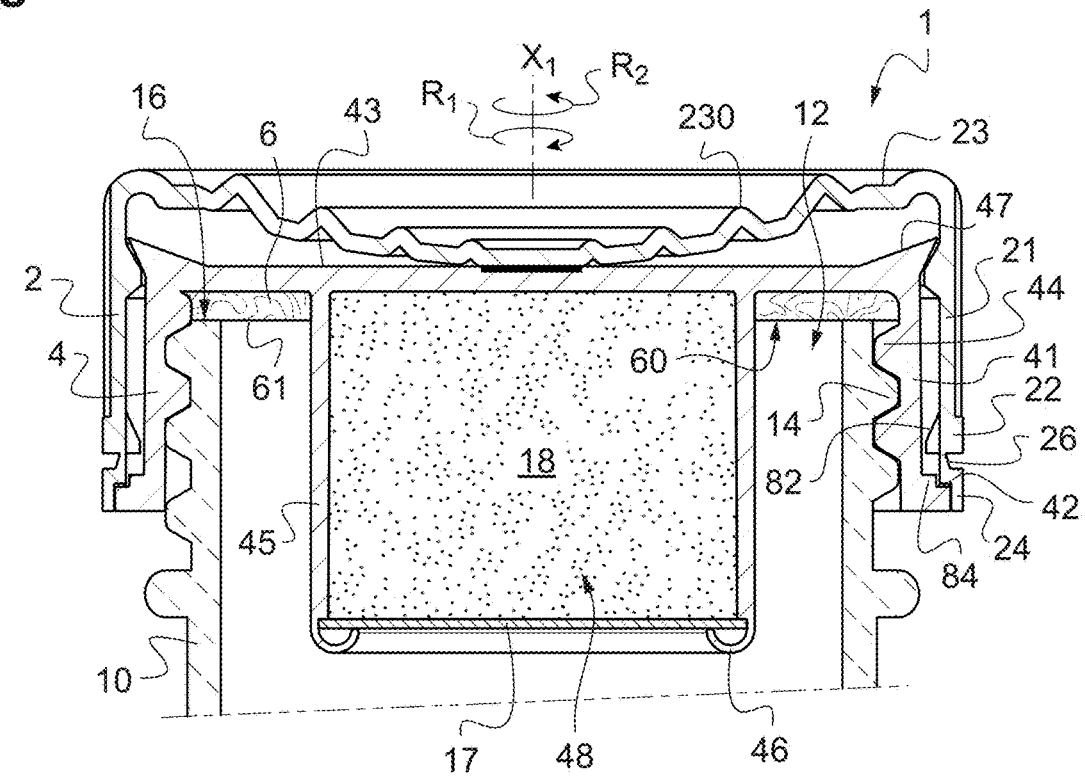
FIG. 14 is a cross section at larger scale according to plane XIV of FIG. 13.
Figure 15:
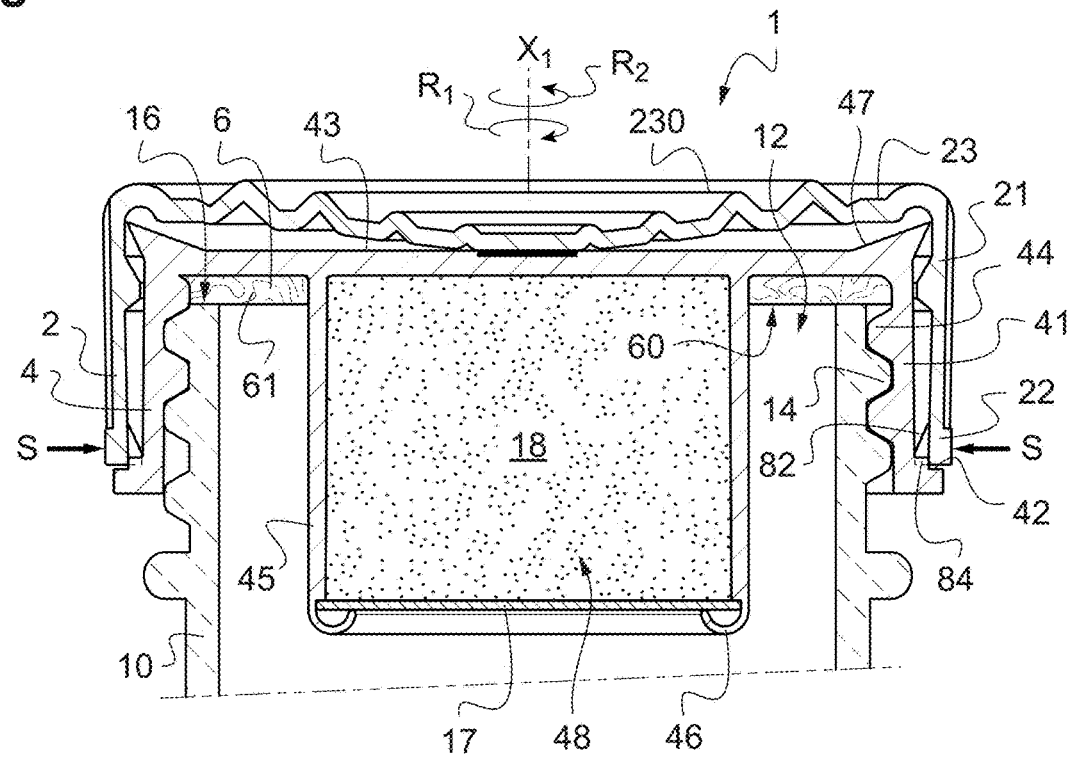
FIG. 15 is a cross section similar to FIG. 14, in a configuration of the tamper-evident closure corresponding to a step of unscrewing the closure from a container.

In the third embodiment shown in FIGS. 13 to 15, elements that are similar to those of the first embodiment have the same references. The tamper-evident closure 1 of the third embodiment differs from the second embodiment in that the top wall 23 of the outer cap 2 comprises a central portion 230 with an accordion-like structure and a concave shape, which is attached to the top wall 43 of the inner cap 4. The accordion-like concave central portion 230 forms a spring structure configured to axially bias the distal end 22 of the outer cap 2 from the outer flange 42 of the inner cap 4 in the direction of the main axis $X_1$, when the safety strip 24 is removed. It is understood that, in FIGS. 14 to 16, the thickened line between the central portion 230 of the outer cap 2 and the top wall 43 of the inner cap 4 is a representation of the contact surface at this junction between the outer cap and the inner cap.

In the third embodiment of FIGS. 13 to 15, the second engagement mechanism of the closure 1 is a "squeeze-and-turn" child-resistant mechanism comprising radial teeth 82 and 84 similar to those of the second embodiment. However, it is understood that the accordion-like concave central portion 230 of the third embodiment, forming a spring structure, can also be implemented with a "push-and-turn" child-resistant mechanism comprising coupling elements 72 and 74 similar to those of the first embodiment.

Figure 16:
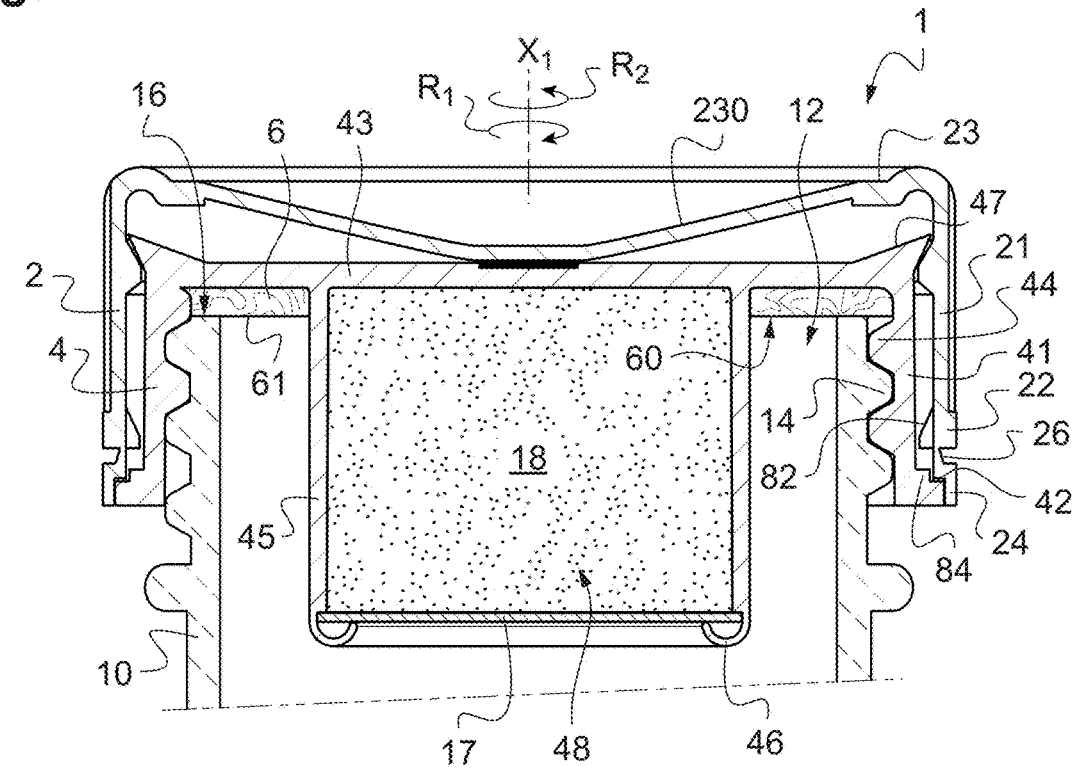
FIG. 16 is a cross section similar to FIG. 14 for a variant of the tamper-evident closure of the third embodiment.

In variants of the third embodiment, the central portion 230 of the top wall 23 of the outer cap 2 may form a spring structure through other designs than the accordion-like design shown in FIGS. 13 to 15. For example, the accordion-like concave structure may be replaced by a conical concave structure as shown in FIG. 16, subject to the selection of a suitable material for the central portion 230 in order to control the deformation of the outer cap 2. In a variant, the central portion 230 may also be made of a material different from the rest of the outer cap 2, should it be the accordion-like concave central portion shown in FIGS. 13 to 15 or any other shape of central portion. In another variant not shown in the figures, the accordion-like concave structure of the third embodiment may be replaced by a concave structure with concentric grooves for improved control of the deformation of the outer cap 2.

In all embodiments, the outer cap 2, comprising the safety strip 24, and the inner cap 4 are advantageously manufactured by injection molding of suitable polymer material(s), which may be one and the same polymer material for all of the outer cap and the main body of the inner cap, or different polymer materials selected according to the intended function of each cap, or even according to the intended function of each portion of each cap. Examples of suitable polymers for both the outer cap and the main body of the inner cap include polyolefin-based polymers, in particular polyethylene or polypropylene. In one embodiment, the constitutive polymer of the outer cap 2 is the same as the constitutive polymer of the main body 40 of the inner cap 4, e.g. high-density polyethylene (HDPE). In another embodiment, the constitutive polymer of the outer cap 2 is different from the constitutive polymer of the main body 40 of the inner cap 4, e.g. the outer cap may be made of polypropylene (PP) or polyoxymethylene (POM), whereas the main body of the inner cap may be made of high-density polyethylene (HDPE). Polypropylene (PP) and polyoxymethylene (POM) are polymer materials that are advantageous for the outer cap, especially as they are materials that are brittle enough to allow the rupture of the frangible structure 26, but they are also flexible materials, which is required for the elastic properties of the outer cap.

The constitutive material of the sealing insert 6 may also be a specific polymer, especially with a Young's coefficient lower than that of the main body 40 of the inner cap 4. By way of a non-limiting example, when the main body 40 of the inner cap 4 is made of HDPE, the sealing member 6 may be made of a thermoplastic elastomer (TPE) having a Shore A hardness of between 30 and 70. By way of non-limiting examples, the sealing member 6 may be made of a thermoplastic elastomer selected in the TPV-Elastron® V Series, which are cross-linked EPDM based thermoplastic elastomer vulcanizates designed for use in medical applications, e.g., the products Elastron® P.V101 such as Elastron® P.V101.A40.B having a Shore A hardness of 40 measured according to standard ASTM D2240, or Elastron® P.V101.A60.B having a Shore A hardness of 60 measured according to standard ASTM D2240.

The constitutive materials of the closure and the container of the invention, as well as the active material received in the cavity of the closure for regulation of the atmosphere inside the container, are selected according to the intended use of the container. An advantage of the closure according to the invention is its high versatility, as it can be used for all screw-necked bottles or containers. Without any modification to a conventional screw necked bottle or container, it is possible to combine the three functions of being child-resistant, tamper-evident and providing active control of the atmosphere in the container. Because of its high safety, a container with a closure according to the invention is advantageously used for storing tablets or capsules containing a pharmaceutical composition; nutraceuticals; herbalism products; or diagnostic products.

The invention is not limited to the examples described and shown.

In particular, the geometry, the number, and the arrangement of the coupling elements of the first and second engagement mechanisms may be different from those described above. It is notably understood that the invention may be implemented with any type of second engagement mechanism, e.g., a "push-and-turn" child-resistant mechanism, a "squeeze-and-turn" child-resistant mechanism, a "push-and-squeeze-and-turn" child-resistant mechanism, as long as the removal of the safety strip 24 releases at least one degree of freedom of relative movement between the outer cap 2 and the inner cap 4.

For example, for a "push-and-turn" child-resistant mechanism, the coupling elements 72, 74 of the second engagement mechanism may be located between the distal end 22 of the outer cap and the outer flange 42 of the inner cap, instead of being located between the first and second top walls 23 and 43 as shown in the first embodiment described above. For a "squeeze-and-turn" child-resistant mechanism, the coupling elements 82, 84 of the second engagement mechanism may be located at a same height along the main axis $X_1$ when the safety strip 24 is attached between the outer cap and the inner cap, instead of being axially offset as shown in the second embodiment described above, so that no relative axial movement of the outer and inner caps is required to activate the second engagement mechanism.

According to one variant, the child-resistance of the closure may also be obtained without a reversible elastic deformation of the outer cap 2, but instead by using at least one elastic member positioned between the outer cap 2 and the inner cap 4 and configured to bias the outer cap 2 and the inner cap 4 away from each other.

According to one variant, the safety strip 24 may also be integral with the inner cap 4 instead of being integral with the outer cap 2. As already mentioned, the frangible structure may also comprise a plurality of frangible bridges regularly distributed at the periphery between the safety strip 24 and the distal end 22, instead of a continuous thinned portion of material.

The sealing member 6 may also have other shapes than those shown in the figures. In particular, a closure according to the invention may comprise a lip seal member molded in one piece with the inner cap 4 and configured to provide a moisture-tight seal between the inner cap and an internal or external surface of a neck of the container. Such a lip seal member may be provided instead of, or in addition to, a sealing member defining a flat sealing surface. Of course, in the case of a sealing member 6 attached to the inner cap 4, the sealing member may be attached to the inner cap by any suitable means, such as overmolding, heat sealing, adhesive bonding, etc.

In addition, a container with a closure according to the invention may be different from the container 10 shown in the figures, in particular the container may have other shapes, possibly with non-rotational geometries, as long as it is provided with an opening which is provided, either externally as shown in the figures or internally, with an annular container thread, which may be a continuous thread or an interrupted thread, on which the closure can be screwed. As readily understood, when the container thread is arranged internally, i.e. on the inner surface of the container opening, the cap thread is advantageously provided on an outer surface of an annular wall of the inner cap configured to be received inside the container opening.

Of course, many other variants can be considered, falling within the scope of the appended claims.

The invention claimed is:

1. A tamper-evident closure for a container having an opening with a thread, the closure comprising:

an outer cap with a first sidewall and a first top wall;

an inner cap with a second sidewall and a second top wall, the inner cap comprising a cap thread to cooperate with the container thread, wherein the inner cap is coaxially nested in the outer cap;

a safety strip between the outer cap and the inner cap to block at least one degree of freedom of relative movement of the outer and inner caps, wherein the safety strip is integrally made with one cap among the outer and inner caps and connected thereto by a frangible structure;

a first engagement mechanism comprising a structural element of the safety strip that interacts with a structural element of the other cap among the outer and inner caps to drive the outer and inner caps in unison in a direction of screwing the cap thread onto the container thread to mount the closure on the container, wherein the first engagement mechanism is activatable without breaking the frangible structure, by application on the outer cap of a rotational torque in the direction of screwing;

a second engagement mechanism comprising a structural element of the outer cap that interacts with a structural element of the inner cap to drive the outer and inner caps in unison in a direction of unscrewing the cap thread relative to the container thread to remove the closure from the container, wherein the second engagement mechanism is activatable when the safety strip has been removed, by application on the outer cap of a rotational torque in the direction of unscrewing and at least one additional force for activating at least one degree of freedom of relative movement of the outer and inner caps originally blocked by the safety strip.

2. The tamper-evident closure according to claim 1, wherein the safety strip keeps, at least locally, facing walls of the outer and inner caps at a first distance from each other, wherein the second engagement mechanism is activatable, when the safety strip has been removed, by application on the outer cap of a rotational torque in the direction of unscrewing and at least one additional force to bring the facing walls of the outer and inner caps, at least locally, to a second distance from each other less than the first distance.

3. The tamper-evident closure according to claim 1, wherein the inner cap is coaxially nested in the outer cap and shaped to allow a relative axial movement such that the first and second top walls of the outer and inner caps can be moved towards or away from each other in a direction of a main axis of the closure, wherein the safety strip keeps, at least locally, the first and second top walls at a first axial distance from each other, wherein the second engagement mechanism is activatable, when the safety strip has been removed, by application on the outer cap of a rotational torque in the direction of unscrewing and an additional force which is an axial force in the direction of the main axis to bring the first and second top walls, at least locally, to a second axial distance from each other less than the first axial distance.

4. The tamper-evident closure according to claim 1, wherein the inner cap is coaxially nested in the outer cap and shaped to allow a relative radial movement such that the first and second sidewalls of the outer and inner caps can be moved towards or away from each other in a direction transverse to a main axis of the closure, wherein the safety strip keeps, at least locally, the first and second sidewalls at a first radial distance from each other, wherein the second engagement mechanism is activatable, when the safety strip has been removed, by application on the outer cap of a rotational torque in the direction of unscrewing and an additional force which is a radial force in the direction transverse to the main axis to bring the first and second sidewalls, at least locally, to a second radial distance from each other less than the first radial distance.

5. The tamper-evident closure according to claim 1, wherein the safety strip is made of the same material as the cap to which it is connected by the frangible structure.

6. The tamper-evident closure according to claim 1, wherein the safety strip comprises an injection molded part made in one piece with the frangible structure and the cap to which it is connected by the frangible structure.

7. The tamper-evident closure according to claim 1, wherein the safety strip comprises a grip tab.

8. The tamper-evident closure according to claim 1, wherein the frangible structure comprises a continuous thinned portion between the safety strip and the cap to which it is connected by the frangible structure.

9. The tamper-evident closure according to claim 1, wherein, when the safety strip has been removed, the structural elements of the second engagement mechanism are brought in mutual engagement under the effect of the at least one additional force against an elastic action of at least one elastic element of the closure, in such a way that the structural elements of the second engagement mechanism are disengaged when the at least one additional force is released.

10. The tamper-evident closure according to claim 9, wherein the outer cap is elastically deformable, the structural elements of the second engagement mechanism being brought in mutual engagement by reversible elastic deformation of the outer cap.

11. The tamper-evident closure according to claim 1, wherein the inner cap comprises a sealing member to provide a moisture-tight seal between the inner cap and the container opening, wherein the sealing member comprises a flat sealing surface forming an inner surface of the inner cap positioned transversally to a main axis of the closure to provide a moisture-tight seal between the inner cap and an upper surface of the container opening.

12. The tamper-evident closure according to claim 11, wherein the sealing member comprises a thermoplastic elastomer (TPE) having a Shore A hardness of between 30 and 70.

13. The tamper-evident closure according to claim 1, wherein the structural elements of the first engagement mechanism are complementary to one another, wherein, when a rotational torque in the direction of screwing is applied on the outer cap, the structural elements of the first engagement mechanism are in a locking arrangement with one another so that the inner cap is rotated in unison with the outer cap in the direction of screwing.

14. The tamper-evident closure according to claim 1, wherein the inner cap defines a cavity for receiving an active material capable of regulating an atmosphere in a container equipped with the closure.

15. A container with the closure according to claim 1, wherein the closure is fixedly screwed onto a thread of the container.

* * * * *